US008850899B2

(12) United States Patent
Snider

(10) Patent No.: US 8,850,899 B2
(45) Date of Patent: Oct. 7, 2014

(54) PRODUCTION LOGGING PROCESSES AND SYSTEMS

(75) Inventor: Philip M Snider, Houston, TX (US)

(73) Assignee: Marathon Oil Company, Houston, TX (US)

( * ) Notice: Subject to any disclaimer, the term of this patent is extended or adjusted under 35 U.S.C. 154(b) by 536 days.

(21) Appl. No.: 13/081,926

(22) Filed: Apr. 7, 2011

(65) Prior Publication Data

US 2011/0252878 A1 Oct. 20, 2011

Related U.S. Application Data

(60) Provisional application No. 61/324,621, filed on Apr. 15, 2010.

(51) Int. Cl.
*G01F 1/708* (2006.01)
*E21B 47/10* (2012.01)

(52) U.S. Cl.
CPC ..... *E21B 47/1015* (2013.01)
USPC ..... 73/861.05

(58) Field of Classification Search
None
See application file for complete search history.

(56) References Cited

U.S. PATENT DOCUMENTS

| | | | | |
|---|---|---|---|---|
| 3,684,008 | A | | 8/1972 | Garrett |
| 3,706,094 | A | | 12/1972 | Cole et al. |
| 4,023,167 | A | | 5/1977 | Wahlstrom |
| 4,096,477 | A | | 6/1978 | Epstein et al. |
| 4,119,146 | A | | 10/1978 | Taylor |
| 4,166,215 | A | | 8/1979 | Anderson |
| 4,166,216 | A | * | 8/1979 | Cubberly, Jr. ..... 250/260 |
| 4,271,925 | A | | 6/1981 | Burg |
| 4,535,430 | A | | 8/1985 | Cochrane et al. |
| 4,572,293 | A | | 2/1986 | Wilson et al. |
| 4,599,182 | A | | 7/1986 | Young et al. |
| 4,622,463 | A | | 11/1986 | Hill |
| 4,630,044 | A | | 12/1986 | Polzer |
| 4,656,463 | A | | 4/1987 | Anders et al. |
| 4,656,944 | A | | 4/1987 | Gonzalez |
| 4,698,631 | A | | 10/1987 | Kelly, Jr. et al. |
| 4,808,925 | A | | 2/1989 | Baird |
| 4,827,395 | A | | 5/1989 | Anders et al. |
| 4,837,515 | A | | 6/1989 | Nishihara et al. |
| 4,977,961 | A | | 12/1990 | Avasthi |
| 5,029,644 | A | | 7/1991 | Szarka et al. |
| 5,047,632 | A | * | 9/1991 | Hunt ..... 250/302 |

(Continued)

FOREIGN PATENT DOCUMENTS

| | | |
|---|---|---|
| EP | 0013494 A1 | 7/1980 |
| EP | 0412535 B1 | 2/1991 |

(Continued)

OTHER PUBLICATIONS

U.S. Office Communication from U.S. Appl. No. 12/102,687 dated Jun. 19, 2012.

(Continued)

*Primary Examiner* — Harshad R Patel
(74) *Attorney, Agent, or Firm* — Jack E. Ebel

(57) ABSTRACT

Processes and systems for logging production of fluid produced into a well bore without intervention of the well are disclosed. Two or more markers may be introduced into produced fluid at spaced apart locations along a well. The time for each marker to reach a common point may be measured and production rates for produced fluids at each spaced apart location may be calculated.

20 Claims, 1 Drawing Sheet

(56) References Cited

U.S. PATENT DOCUMENTS

| | | | | |
|---|---|---|---|---|
| 5,105,742 | A | 4/1992 | Sumner | |
| 5,130,705 | A | 7/1992 | Allen et al. | |
| 5,142,128 | A | 8/1992 | Perkin et al. | |
| 5,160,925 | A | 11/1992 | Dailey et al. | |
| 5,182,939 | A * | 2/1993 | Chien et al. | 73/29.01 |
| 5,191,936 | A | 3/1993 | Edwards et al. | |
| 5,202,680 | A | 4/1993 | Savage | |
| 5,206,680 | A | 4/1993 | Dillow | |
| 5,230,387 | A | 7/1993 | Waters et al. | |
| 5,279,366 | A | 1/1994 | Scholes | |
| 5,354,956 | A | 10/1994 | Orban et al. | |
| 5,355,957 | A | 10/1994 | Burleson et al. | |
| 5,361,838 | A | 11/1994 | Kilgore | |
| 5,394,141 | A | 2/1995 | Soulier | |
| 5,457,447 | A | 10/1995 | Ghaem et al. | |
| 5,467,083 | A | 11/1995 | McDonald et al. | |
| 5,479,860 | A | 1/1996 | Ellis | |
| 5,495,237 | A | 2/1996 | Yuasa et al. | |
| 5,497,140 | A | 3/1996 | Tuttle | |
| 5,505,134 | A | 4/1996 | Brooks et al. | |
| 5,530,358 | A | 6/1996 | Wisler et al. | |
| 5,608,199 | A | 3/1997 | Clouse, III et al. | |
| 5,621,647 | A | 4/1997 | Kraemer et al. | |
| 5,626,192 | A | 5/1997 | Connell et al. | |
| 5,629,623 | A | 5/1997 | Sezginer et al. | |
| 5,654,693 | A | 8/1997 | Cocita | |
| 5,660,232 | A | 8/1997 | Reinhardt | |
| 5,680,459 | A | 10/1997 | Hook et al. | |
| 5,680,905 | A | 10/1997 | Green et al. | |
| 5,682,099 | A | 10/1997 | Thompson et al. | |
| 5,682,143 | A | 10/1997 | Brady et al. | |
| 5,706,896 | A | 1/1998 | Tubel et al. | |
| 5,720,345 | A | 2/1998 | Price et al. | |
| 5,829,538 | A | 11/1998 | Wesson et al. | |
| 5,836,406 | A | 11/1998 | Schuh | |
| 5,864,323 | A | 1/1999 | Berthon | |
| 5,877,996 | A | 3/1999 | Krokstad et al. | |
| 5,911,277 | A | 6/1999 | Hromas et al. | |
| 5,923,167 | A | 7/1999 | Chang et al. | |
| 5,931,239 | A | 8/1999 | Schuh | |
| 5,939,885 | A | 8/1999 | McClure et al. | |
| 5,955,666 | A | 9/1999 | Mullins | |
| 5,991,602 | A | 11/1999 | Sturm | |
| 5,995,449 | A | 11/1999 | Green et al. | |
| 6,018,501 | A | 1/2000 | Smith et al. | |
| 6,025,780 | A | 2/2000 | Bowers et al. | |
| 6,078,259 | A | 6/2000 | Brady et al. | |
| 6,081,729 | A | 6/2000 | Bauerschmidt et al. | |
| 6,085,805 | A | 7/2000 | Bates | |
| 6,097,301 | A | 8/2000 | Tuttle | |
| 6,105,688 | A | 8/2000 | Vaynshteyn et al. | |
| 6,125,934 | A * | 10/2000 | Lenn et al. | 166/250.12 |
| 6,130,602 | A | 10/2000 | O'Toole et al. | |
| 6,135,206 | A | 10/2000 | Gano et al. | |
| 6,151,961 | A | 11/2000 | Huber et al. | |
| 6,158,532 | A | 12/2000 | Logan et al. | |
| 6,176,318 | B1 | 1/2001 | Drakeley et al. | |
| 6,181,138 | B1 | 1/2001 | Hagiwara et al. | |
| 6,184,685 | B1 | 2/2001 | Paulk et al. | |
| 6,189,621 | B1 | 2/2001 | Vail, III | |
| 6,243,041 | B1 | 6/2001 | Mischenko et al. | |
| 6,249,258 | B1 | 6/2001 | Bloch et al. | |
| 6,253,842 | B1 | 7/2001 | Connell et al. | |
| 6,257,338 | B1 | 7/2001 | Kilgore | |
| 6,288,548 | B1 | 9/2001 | Thompson et al. | |
| 6,288,685 | B1 | 9/2001 | Thomas | |
| 6,324,904 | B1 | 12/2001 | Ishikawa et al. | |
| 6,333,699 | B1 | 12/2001 | Zierolf | |
| 6,333,700 | B1 | 12/2001 | Thomeer et al. | |
| 6,343,649 | B1 | 2/2002 | Beck et al. | |
| 6,359,569 | B2 | 3/2002 | Beck et al. | |
| 6,366,089 | B1 | 4/2002 | Poitzsch et al. | |
| 6,426,917 | B1 | 7/2002 | Tabanou et al. | |
| 6,429,653 | B1 | 8/2002 | Kruspe et al. | |
| 6,443,228 | B1 | 9/2002 | Aronstam et al. | |
| 6,450,258 | B2 | 9/2002 | Green et al. | |
| 6,476,609 | B1 | 11/2002 | Bittar | |
| 6,481,505 | B2 | 11/2002 | Beck et al. | |
| 6,497,280 | B2 | 12/2002 | Beck et al. | |
| 6,515,919 | B1 | 2/2003 | Lee | |
| 6,531,871 | B1 | 3/2003 | Hay et al. | |
| 6,536,524 | B1 | 3/2003 | Snider | |
| 6,575,237 | B2 | 6/2003 | Purkis et al. | |
| 6,577,244 | B1 | 6/2003 | Clark et al. | |
| 6,588,505 | B2 | 7/2003 | Beck et al. | |
| 6,597,175 | B1 | 7/2003 | Brisco | |
| 6,614,229 | B1 | 9/2003 | Clark et al. | |
| 6,717,501 | B2 | 4/2004 | Hall et al. | |
| 6,759,968 | B2 | 7/2004 | Zierolf | |
| 6,761,219 | B2 | 7/2004 | Snider et al. | |
| 6,766,703 | B1 | 7/2004 | Kluth et al. | |
| 6,788,263 | B2 | 9/2004 | Clark et al. | |
| 6,822,579 | B2 | 11/2004 | Goswami et al. | |
| 6,915,848 | B2 | 7/2005 | Thomeer et al. | |
| 6,943,697 | B2 | 9/2005 | Ciglenec et al. | |
| 6,989,764 | B2 | 1/2006 | Thomeer et al. | |
| 7,014,100 | B2 | 3/2006 | Zierolf | |
| 7,063,148 | B2 | 6/2006 | Jabusch | |
| 7,159,654 | B2 | 1/2007 | Ellison et al. | |
| 7,268,688 | B2 | 9/2007 | Juds | |
| 7,283,061 | B1 | 10/2007 | Snider et al. | |
| 7,400,263 | B2 | 7/2008 | Snider et al. | |
| 7,677,439 | B2 | 3/2010 | Zierolf | |
| 7,714,741 | B2 | 5/2010 | Snider et al. | |
| 8,001,858 | B2 | 8/2011 | Cogen et al. | |
| 8,044,820 | B2 | 10/2011 | Snider et al. | |
| 8,091,775 | B2 | 1/2012 | Zierolf | |
| 2001/0013410 | A1 | 8/2001 | Beck et al. | |
| 2001/0013411 | A1 | 8/2001 | Beck et al. | |
| 2001/0042617 | A1 | 11/2001 | Beck et al. | |
| 2001/0043146 | A1 | 11/2001 | Beck et al. | |
| 2001/0054969 | A1 | 12/2001 | Thomeer et al. | |
| 2002/0007949 | A1 | 1/2002 | Tolman et al. | |
| 2002/0014966 | A1 | 2/2002 | Strassner et al. | |
| 2002/0093431 | A1 | 7/2002 | Zierolf | |
| 2002/0133942 | A1 | 9/2002 | Kenison et al. | |
| 2002/0158120 | A1 | 10/2002 | Zierolf | |
| 2003/0058125 | A1 | 3/2003 | Ciglenec et al. | |
| 2003/0090390 | A1 | 5/2003 | Snider et al. | |
| 2004/0211567 | A1 | 10/2004 | Aud | |
| 2004/0239521 | A1 | 12/2004 | Zierolf | |
| 2005/0115708 | A1 | 6/2005 | Jabusch | |
| 2005/0237200 | A1 | 10/2005 | Bellum et al. | |
| 2006/0175404 | A1 | 8/2006 | Zierolf | |
| 2008/0271887 | A1 | 11/2008 | Snider et al. | |
| 2009/0223663 | A1 | 9/2009 | Snider et al. | |
| 2009/0223670 | A1 | 9/2009 | Snider | |
| 2010/0013664 | A1 | 1/2010 | Zierolf | |
| 2010/0171593 | A1 | 7/2010 | Zierolf | |
| 2010/0193184 | A1 * | 8/2010 | Dolman et al. | 166/253.1 |
| 2010/0219980 | A1 | 9/2010 | Snider et al. | |
| 2012/0298243 | A1 | 11/2012 | Zierolf | |

FOREIGN PATENT DOCUMENTS

| | | | |
|---|---|---|---|
| EP | 0651132 | A2 | 5/1995 |
| EP | 0730083 | A2 | 9/1996 |
| EP | 1152262 | A1 | 11/2001 |
| FR | 1033631 | | 7/1953 |
| SU | 1657627 | A1 | 6/1991 |
| WO | 00/45195 | | 8/2000 |
| WO | 01/18357 | A2 | 3/2001 |
| WO | 01/73423 | A1 | 10/2001 |
| WO | 2006/101618 | A2 | 9/2006 |
| WO | 2009/114356 | A1 | 9/2009 |
| WO | 2011/130176 | A1 | 10/2011 |

OTHER PUBLICATIONS

U.S. Office Communication from U.S. Appl. No. 12/102,687 dated Aug. 1, 2013.

U.S. Office Communication from U.S. Appl. No. 13/302,618 dated Jan. 10, 2013.

(56) References Cited

OTHER PUBLICATIONS

U.S. Office Communication from U.S. Appl. No. 13/302,618 dated Jun. 13, 2013.
U.S. Office Communication from U.S. Appl. No. 13/302,618 dated Sep. 9, 2013.
U.S. Office Communication from U.S. Appl. No. 12/044,087 dated Feb. 28, 2014.
U.S. Office Communication from U.S. Appl. No. 12/102,687 dated Jan. 13, 2014.
U.S. Office Communication from U.S. Appl. No. 13/302,618 dated Feb. 11, 2014.
U.S. Office Communication from U.S. Appl. No. 12/044,087 dated Dec. 5, 2011.
U.S. Office Communication from U.S. Appl. No. 12/102,687 dated Oct. 20, 2011.
U.S. Office Communication from U.S. Appl. No. 12/564,780 dated Aug. 24, 2011.
Den-Con Tool Co., General Catalog, 1994-95, pp. 1-3.
Varpakhovich G A; RU 2057334C1: Method of Identification of Objects and Plant for its Realization; Mar. 27, 1996; pp. 1-2; Derwent Record.
U.S. Office Communication from U.S. Appl. No. 09/286,650 dated Jul. 3, 2000.
U.S. Office Communication from U.S. Appl. No. 09/286,650 dated Jan. 12, 2001.
U.S. Office Communication from U.S. Appl. No. 09/286,650 dated Oct. 12, 2001.
U.S. Office Communication from U.S. Appl. No. 09/586,648 dated Dec. 18, 2003.
U.S. Office Communication from U.S. Appl. No. 09/586,648 dated Aug. 26, 2004.
U.S. Office Communication from U.S. Appl. No. 09/586,648 dated Sep. 29, 2005.
U.S. Office Communication from U.S. Appl. No. 09/656,720 dated Feb. 26, 2002.
U.S. Office Communication from U.S. Appl. No. 09/843,998 dated Aug. 29, 2002.
U.S. Office Communication from U.S. Appl. No. 09/843,998 dated Mar. 28, 2003.
U.S. Office Communication from U.S. Appl. No. 09/843,998 dated Dec. 9, 2003.
U.S. Office Communication from U.S. Appl. No. 09/843,998 dated Jul. 28, 2004.
U.S. Office Communication from U.S. Appl. No. 09/843,998 dated Mar. 24, 2005.
U.S. Office Communication from U.S. Appl. No. 10/032,114 dated Aug. 13, 2003.
U.S. Office Communication from U.S. Appl. No. 10/032,114 dated Feb. 24, 2004.
U.S. Office Communication from U.S. Appl. No. 10/323,536 dated Dec. 27, 2006.
U.S. Office Communication from U.S. Appl. No. 10/323,536 dated May 14, 2007.
U.S. Office Communication from U.S. Appl. No. 10/323,536 dated Feb. 5, 2008.
U.S. Office Communication from U.S. Appl. No. 10/323,536 dated Apr. 11, 2008.
U.S. Office Communication from U.S. Appl. No. 10/726,027 dated Jul. 11, 2005.
U.S. Office Communication from U.S. Appl. No. 10/887,366 dated Dec. 5, 2006.
U.S. Office Communication from U.S. Appl. No. 10/887,366 dated May 17, 2007.
U.S. Office Communication from U.S. Appl. No. 10/887,366 dated Aug. 21, 2007.
U.S. Office Communication from U.S. Appl. No. 10/887,366 dated Nov. 23, 2007.
U.S. Office Communication from U.S. Appl. No. 10/887,366 dated Jun. 18, 2008.
U.S. Office Communication from U.S. Appl. No. 10/887,366 dated Nov. 10, 2008.
U.S. Office Communication from U.S. Appl. No. 10/887,366 dated Apr. 22, 2009.
U.S. Office Communication from U.S. Appl. No. 11/377,736 dated Oct. 18, 2006.
U.S. Office Communication from U.S. Appl. No. 11/377,736 dated May 7, 2007.
U.S. Office Communication from U.S. Appl. No. 11/377,736 dated Nov. 1, 2007.
U.S. Office Communication from U.S. Appl. No. 11/377,736 dated Jun. 12, 2008.
U.S. Office Communication from U.S. Appl. No. 11/377,736 dated Dec. 12, 2008.
U.S. Office Communication from U.S. Appl. No. 11/377,736 dated May 29, 2009.
U.S. Office Communication from U.S. Appl. No. 12/044,087 dated Apr. 22, 2010.
U.S. Office Communication from U.S. Appl. No. 12/044,087 dated Jul. 30, 2010.
U.S. Office Communication from U.S. Appl. No. 12/044,087 dated Jan. 13, 2011.
U.S. Office Communication from U.S. Appl. No. 12/102,687 dated Aug. 2, 2010.
U.S. Office Communication from U.S. Appl. No. 12/102,687 dated Nov. 5, 2010.
U.S. Office Communication from U.S. Appl. No. 12/102,687 dated Apr. 6, 2011.
U.S. Office Communication from U.S. Appl. No. 12/173,693 dated Feb. 25, 2009.
U.S. Office Communication from U.S. Appl. No. 12/173,693 dated Jun. 4, 2009.
U.S. Office Communication from U.S. Appl. No. 12/173,693 dated Aug. 21, 2009.
U.S. Office Communication from U.S. Appl. No. 12/564,780 dated Mar. 16, 2011.
U.S. Office Communication from U.S. Appl. No. 12/725,254 dated Jun. 4, 2010.
U.S. Office Communication from U.S. Appl. No. 12/725,254 dated Nov. 2, 2010.
U.S. Office Communication from U.S. Appl. No. 12/725,254 dated Apr. 14, 2011.
U.S. Office Communication from U.S. Appl. No. 12/044,087 dated May 24, 2011.

* cited by examiner

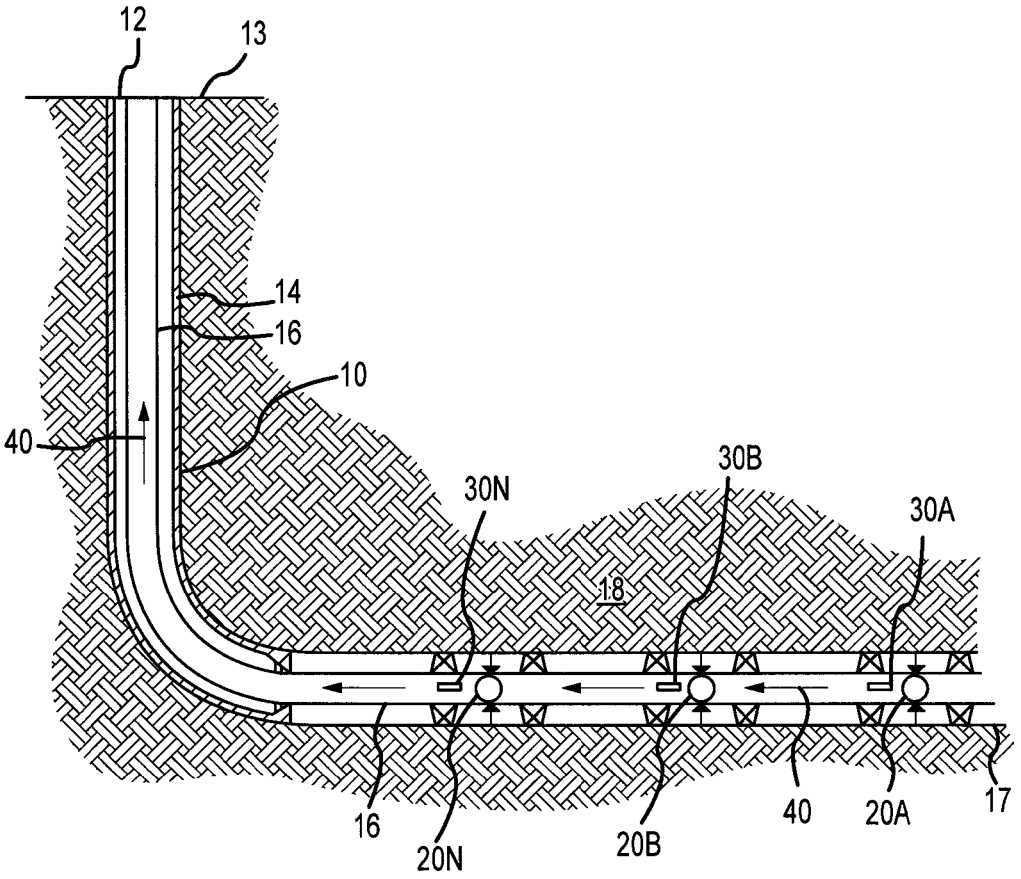
12
13
14
16
10
40
30N
30B
30A
18
16
20N
20B
40
20A
17

PRODUCTION LOGGING PROCESSES AND SYSTEMS

BACKGROUND OF THE INVENTION

1. Field of the Invention

The present invention relates to processes and systems for obtaining flow rates of fluids produced from a subterranean well without well intervention, and more particularly, to processes and systems for obtaining flow rates of fluids produced from a substantially horizontal subterranean well without well intervention.

2. Description of Related Art

In the production of fluid from subterranean environs, a well bore may be drilled so as to penetrate one or more subterranean environs. The well bore may be drilled into or through the one or more subterranean environs of interest in a generally vertical, deviated or horizontal orientation. The well is typically completed by positioning casing which may be made up of tubular joints into the well bore and securing the casing therein by any suitable means, such as cement positioned between the casing and the walls of the well bore. Thereafter, the well may be completed in a typical manner by conveying a perforating gun or other means of penetrating casing to a position that is adjacent the subterranean environs of interest and detonating explosive charges so as to perforate both the casing and the subterranean environs. In this manner, fluid communication may be established between the subterranean environs and the interior of the casing to permit the flow of fluid from the subterranean environs into the well. Alternatively, the well may be completed as an "open hole", meaning that casing is installed in the well bore but terminates above the subterranean environs of interest. The well may be subsequently equipped with production tubing and conventional associated equipment so as to produce fluid from the subterranean environs of interest to the surface. The casing and/or tubing may also be used to inject fluid into the well to assist in production of fluid therefrom or into the subterranean environs to assist in extracting fluid therefrom.

Further, it is often desirable to stimulate the subterranean environs of interest to enhance production of fluids, such as hydrocarbons, therefrom by pumping fluid under pressure into the well and the surrounding subterranean environs of interest to stimulate the environs, for example by inducing hydraulic fracturing thereof. Thereafter, fluid can be produced from the subterranean environs of interest, into the well bore and through the production tubing and/or casing string to the surface of the earth. Where it is desired to stimulate, for example fracture, the subterranean environs of interest at multiple, spaced apart locations along a well bore penetrating the environs, fluid is pumped into a particular location adjacent the subterranean environs of interest while means, such as a flapper valve(s) or gelled fluids placed in the open hole, is employed to isolate the remaining locations. Once fluid is pumped under pressure from the surface into the well and the particular location, means are actuated to isolate the next location and fluid is pumped under pressure from the surface into the well and the subterranean environs adjacent the isolated location so as to hydraulically fracture the same. In this manner, all of the subterranean environs adjacent to the multiple, spaced apart locations can be hydraulically fractured. Conventional systems and associated methodology that are used to stimulate subterranean environs in this manner include casing conveyed perforating systems, ball drop systems, and perforate and plug systems.

Once communication is established between the subterranean environs of interest and a well bore, it may often be desirable to determine the nature of production from the subterranean environs, especially when communication is established at multiple locations along the well bore. Production logs may be run to determine the productivity or injectivity of the subterranean environs. Conventional production logging systems require access to the well bore at appropriate depths along the subterranean environs of interest to determine flow rates of fluids produced from such environs by a myriad of means involving direct measurement. Measurement tools are conveyed on wireline or pipe requiring an appropriate rig and the time and expense associated therewith. Flow regimes may be significantly disturbed while operating conventional production logging equipment. As conveyance of such measurement tools in highly deviated or horizontal wells may often be difficult and expensive, e.g. requiring production from the well to be shut in or stopped and sand to be removed by circulating fluid through the well bore, production logs are not run in the vast majority of deviated the vast majority of deviated wells. Instead only total fluid returns are measured at the surface well head.

SUMMARY OF THE INVENTION

To achieve the foregoing and other objects, and in accordance with the purposes of the present invention, as embodied and broadly described herein, one characterization of the present invention may comprise a process wherein at least two markers are simultaneously released into fluid produced from a subterranean environs at spaced apart locations within a well penetrating and in fluid communication with the subterranean environs. The elapsed time from the step of releasing until each of the two markers reaches a common point along the well is measured and the flow rates of fluid produced from the subterranean environs at each location is determined based upon the elapsed time.

BRIEF DESCRIPTION OF THE DRAWINGS

The accompanying drawing, which is incorporated in and forms part of the specification, illustrates the embodiments of the present invention and, together with the description, serves to explain the principles of the invention.

In the drawing:

FIG. 1 is a sectional view of an embodiment of the present invention that illustrates markers released at two or more spaced apart locations along a well into fluid produced from an environs of interest at such locations in accordance with the processes of the present invention.

DETAILED DESCRIPTION OF THE PREFERRED EMBODIMENTS

The processes and systems of the present invention may be practiced and deployed in a subterranean well 10 which may be formed by any suitable means, such as by a rotary drill string, as will be evident to a skilled artisan. The subterranean well may extend from the surface of the earth 13, including a sea bed or ocean platform, and penetrate one or more subterranean environs 18 of interest. As used throughout this description, the term "environs" refers to one or more subterranean areas, zones, horizons and/or formations that may contain hydrocarbons. The well may have any suitable subterranean configuration, such as generally vertical, generally deviated, generally horizontal, or combinations thereof, as will be evident to a skilled artisan. Once the well is formed, it may be completed by cementing a string of tubulars, e.g. a casing string, in the well and establishing fluid communication between the well and the environs of interest by forming perforations through the casing and into the environs. Such perforations may be formed by any suitable means, such as by conventional perforating guns. Thereafter, production tubing may be positioned within the well and the annulus between the production tubing and casing may be sealed, typically by means of a packer assembly. Fluids, such as oil, gas and/or water, may then be produced from the environs of interest into the well via the perforations in the casing and to the surface via production tubing for transportation and/or processing. Where the well has a generally horizontal configuration through the environs of interest, the well may be provided with intermediate casing 14 which may be secured within the well by any suitable means, for example cement, as will be evident to a skilled artisan. The intermediate casing 14 may extend from the surface of the earth 13 to a point near the environs 18 of interest so as to provide an open hole completion through a substantial portion of the environs 18 of interest that are penetrated by the well. Production casing 16 may also be positioned within the well and may be sized to extend through the intermediate casing 14 and into the open hole 17 of the well within the environs 18 of interest.

In accordance with a broad embodiment of the present invention, two or more markers 30A, 30B, 30N may be conveyed into fluid produced at spaced apart locations 20A, 20B, 20N along a well 10 penetrating and in fluid communication with an environs 18 of interest. These markers may be subsequently produced with the fluid 40 to the well head and detected at a common location. By knowing the diameter and length of tubular 16 through which the fluid 40 may be conveyed and the elapsed time between release of each marker 30A, 30B, 30N into the fluid and detection within the produced fluids 40 at a common location, the velocity and fluid flow rate may be calculated for each location from which the marker may be released into the produced fluid. The marker 30A, 30B, 30N may be any fluid, compound or article that may be produced along with the fluid 40 to the well head 12, for example a signal device, a distinct fluid, or distinct particles. Where the marker is a compound which does not dissolve in fluid or an article, the marker 30A, 30B, 30N may preferably be as buoyant as possible so as to be conveyed with the produced fluids. As the number of spaced apart locations and markers will vary depending upon the exact application, the total number of spaced apart locations along well and associated markers released therefrom is designated by the letter "N".

The term "simultaneously" as used herein in conjunction with the conveyance or release of markers into produced fluids is inclusive of release times of two or more markers that are substantially identical as well as release times that, although not substantially identical, are close enough to permit determination of production rates at spaced apart locations along an environs of interest that are within an acceptable margin of error in view of any fluctuations in overall fluid production rates.

While the markers may be released at different times into the produced fluids, the overall fluid production rate at the surface should remain substantially constant over the period during which all such markers are released and detected so that the velocities and fluid flow rates that may be calculated in accordance with the processes and systems of the present invention are within an acceptable margin of error. In view of this requirement, it is preferred that the markers used in the processes and systems of the present invention may be released at substantially the identical time.

The exact marker employed in the systems and processes of the present invention may depend upon the character of fluid being produced and type of equipment present in the well. For example, where a pump is positioned within a well, a liquid or nano particle may be preferred to a signal device as an article which functions as a marker. The nano particle may be electromagnetic. Detection of the markers will depend upon the type of marker employed and may be made by any suitable means as will be evident to a skilled artisan, including but not limited to visually, changes in pressure and temperature, chemical analysis, and means to read a signal device. In accordance with the embodiments of the present invention, detection occurs at one common location above the most proximal point to the well head at which a marker is conveyed or released into the produced fluids. Such common location may be in the well 10 or at the surface 13, but typically may be at the well head 12.

A "signal device" refers to a device which is capable of generating one or more signals which may be detected. These signals do not have to be unique since multiple devices that may be released simultaneously within a well will arrive at the point of collection in the same order that the devices are released downhole, i.e. the device the closest distance to the collection point will arrive first, the next closest second, etc. Nonlimiting examples of a signal device are a radio frequency identification device (RFID), a device carrying a magnetic bar code, a radioactive device, an acoustic device, a surface acoustic wave (SAW) device, a low frequency magnetic transmitter and any other device that is capable of generating one or more signals. The signal device may have any suitable peripheral configuration and geometric shape, and is sized to permit conveyance with produced fluids through a production tubular to the surface. Some signal devices, for example RFID, may be secured to or embedded in a conveyance device, such as a ball made of a buoyant material, as will be evident to a skilled artisan.

In the embodiment of the processes and systems of the present invention where a fluid may be used as the marker and may be simultaneously released into produced fluid 40 produced at two or more spaced apart locations 20A, 20B, 20N (as indicated by the arrows in FIG. 1) along a well penetrating and in fluid communication with an environs 18 of interest, the fluid may be conveyed to two or more locations along a well 10 penetrating and in fluid communication with the environs of interest by any suitable means, such as by a control line having suitable valves or injection points at each of such locations 20A, 20B, 20N. Where a signal device or compound is employed as the marker, the signal device may be released into the produced fluid 40 by, for example a tool that contains several signal devices which are released simultaneously by any suitable means, such as a timer. Where the well is cased, the markers may be injected into the stream of produced fluids 40, while in an open hole completion, the markers may be injected outwardly into stream of produced fluids 40.

Multiple markers may be simultaneously released at the same downhole location to provide for data validation. In addition, a marker may be injected uphole of the casing perforation that is closest to the surface to determine characteristics, such as turbulence. Where a fluid is used as the marker, samples of the produced fluids may be analyzed at the surface to determine the presence of such tracer fluid.

The following example demonstrates the practice and utility of the present invention, but is not to be construed as limiting the scope thereof.

EXAMPLE

A well is drilled to total depth (TD) so as to penetrate a subterranean formation of interest in a lateral manner. A 4-inch inner diameter production casing is equipped with 15 sliding sleeves and has equipment installed at each sleeve for injecting a buoyant ball into the flow of fluid produced from the formation of interest. Each buoyant ball has an RFID embedded therein. A radio frequency reader device is installed in the well at the top of the lateral to read the RFID in each ball that is produced by the reader. The sliding sleeves are are arranged in series and referred to hereafter as sliding sleeves 1-15, with sliding sleeve 1 being proximal and sliding sleeve 15 being distal to the top of the lateral portion of the well. Based upon a 4-inch inner diameter production casing in the lateral portion of the well, it may be calculated that a barrel of fluid occupies a 64.31 foot length of production casing. The volume of fluid contained in the casing above the top of the lateral to the surface is calculated to be 300 barrels. Further the volume of fluid in the lateral part of the production tubing is set forth in Table 1.

TABLE 1

| Top of Lateral to | Distance (feet) | Fluid Volume (barrels) |
|---|---|---|
| Sleeve 1 | 400 | 6.2 |
| Sleeve 2 | 800 | 12.4 |
| Sleeve 3 | 1,200 | 18.7 |
| Sleeve 4 | 1,600 | 24.9 |
| Sleeve 5 | 2,000 | 31.1 |
| Sleeve 6 | 2,400 | 37.3 |
| Sleeve 7 | 2,800 | 43.5 |
| Sleeve 8 | 3,200 | 49.8 |
| Sleeve 9 | 3,600 | 56.0 |
| Sleeve 10 | 4,000 | 62.2 |
| Sleeve 11 | 4,400 | 68.4 |
| Sleeve 12 | 4,800 | 74.6 |
| Sleeve 13 | 5,200 | 80.9 |
| Sleeve 14 | 5,600 | 87.1 |
| Sleeve 15 | 6,000 | 93.3 |

The well is produced and buoyant balls are simultaneously released into the produced fluid at each sleeve by means of a timer connected to each sleeve. An RFID reader positioned within the well at the top of the lateral segment records the elapsed time that it takes each buoyant ball to be produced to the reader, and the fluid velocity may be calculated because the volumes, distances and times between release and detection points are all known. The results are set forth in Table 2.

TABLE 2

| Ball released from | Time to top of lateral (minutes) | Fluid Velocity (ft/min) |
|---|---|---|
| Sleeve 1 | 9.0 | 44.67 |
| Sleeve 2 | 17.9 | 44.67 |
| Sleeve 3 | 26.9 | 44.67 |
| Sleeve 4 | 35.8 | 44.67 |
| Sleeve 5 | 47.0 | 35.73 |
| Sleeve 6 | 59.2 | 32.75 |
| Sleeve 7 | 72.7 | 29.78 |
| Sleeve 8 | 87.8 | 26.80 |
| Sleeve 9 | 102.5 | 26.80 |
| Sleeve 10 | 124.9 | 17.86 |
| Sleeve 11 | 154.8 | 13.40 |
| Sleeve 12 | 184.6 | 13.40 |
| Sleeve 13 | 229.4 | 8.93 |
| Sleeve 14 | 274.2 | 8.93 |
| Sleeve 15 | 363.7 | 4.47 |

From the foregoing information, production rates at each sleeve may be calculated because the fluid velocity and pipe inner diameter are known as will be evident to a skilled artisan. These rates are set forth in Table 3.

TABLE 3

| Production adjacent to | Total Producing Rate (BFEPD) | Individual Producing Rate (BFEPD) | Percent of Production |
|---|---|---|---|
| Sleeve 1 | 1000 | | 0% |
| Sleeve 2 | 1000 | | 0% |
| Sleeve 3 | 1000 | | 0% |
| Sleeve 4 | 1000 | 200 | 20% |
| Sleeve 5 | 800 | 67 | 6.7% |
| Sleeve 6 | 733 | 67 | 6.7% |
| Sleeve 7 | 667 | 67 | 6.7% |
| Sleeve 8 | 600 | | 0% |
| Sleeve 9 | 600 | 200 | 20% |
| Sleeve 10 | 400 | 100 | 10% |
| Sleeve 11 | 300 | | 0% |
| Sleeve 12 | 300 | 100 | 10% |
| Sleeve 13 | 200 | | 0% |
| Sleeve 14 | 200 | 100 | 10% |
| Sleeve 15 | 100 | 100 | 10% |

Thus, it can be readily appreciated that the processes and systems of the present invention may be employed to determine production rates from multiple, spaced apart locations along a well.

The present invention provides processes and systems for determining the flow rates of fluids produced into a well at spaced apart locations along an environs of interest without requiring intervention of normal production operations. The flow rate information that may be captured using the processes and systems of the present invention may be used to develop and implement a work over of the well and may also be used to determine the most advantageous manner to complete another well.

While the foregoing preferred embodiments of the invention have been described and shown, it is understood that the alternatives and modifications, such as those suggested and others, may be made thereto and fall within the scope of the invention.

I claim:

1. A process comprising:

producing fluid from a subterranean environs into a well at spaced apart locations;

releasing at least two markers into the fluid produced from said subterranean environs, each of the at least two markers being released at different locations of the spaced apart locations;

measuring the elapsed time from the step of releasing until each of said at least two markers reaches a common point along the well, wherein the fluid is produced at a substantially constant production rate during the steps of releasing and measuring; and determining the flow rates of fluid produced from said subterranean environs at each of said spaced apart locations based upon said elapsed time.

2. The process of claim 1 wherein said at least two markers are released substantially simultaneously.

3. The process of claim 1 wherein each of said at least two markers is a signal device.

4. The process of claim 3 wherein said signal device is a device capable of generating one or more signals.

5. The process of claim 3 wherein said signal device is a radio frequency identification device, a device carrying a magnetic bar code, a radioactive device, an acoustic device, a surface acoustic wave (SAW) device or a low frequency magnetic transmitter.

6. The process of claim 1 wherein each of said at least two markers is buoyant.

7. The process of claim 1 wherein each of said at least two markers is a fluid, a compound, or an article.

8. The process of claim 7 wherein the compound or the article is a nano particle.

9. The process of claim 1 wherein the common point is at the well head.

10. The process of claim 1 wherein the common point is at the surface.

11. The process of claim 1 wherein the well has a generally horizontal configuration through the subterranean environs.

12. The process of claim 1 wherein the steps of producing, releasing, measuring and determining are performed without requiring intervention of normal production operations.

13. A process for determining flow rates from a subterranean well comprising:

producing fluid from a subterranean environs into a well at spaced apart locations;

simultaneously releasing at least two markers into the fluid produced from the subterranean environs, each of the at least two markers being released at different locations of the spaced apart locations;

detecting each of said at least two markers at a common point along the well; and determining fluid velocity and flow rate of the fluid produced into the well at each of said spaced apart locations from the diameter of the well through which the fluid is produced and the elapsed time from releasing to detection of each of said at least two markers.

14. The process of claim 13 wherein said well is equipped with a tubular along at least a portion thereof through which said fluid is produced.

15. The process of claim 14 wherein said tubular is casing.

16. The process of claim 14 wherein said well is open hole through at least a portion of the subterranean environs.

17. The process of claim 13 wherein each of said two markers is a radio frequency identification device, a device carrying a magnetic bar code, a radioactive device, an acoustic device, a surface acoustic wave (SAW) device or a low frequency magnetic transmitter.

18. The process of claim 13 wherein each of said two markers is buoyant.

19. The process of claim 13 wherein each of said two markers is a fluid, a compound or an article.

20. The process of claim 13 wherein said step of detecting is performed visually, by detecting changes in temperature, pressure or both, by chemical analysis or by means for reading a signal.

* * * * *